US006644076B2

(12) United States Patent
Huang

(10) Patent No.: US 6,644,076 B2
(45) Date of Patent: Nov. 11, 2003

(54) CYLINDER ASSEMBLY FOR A DOOR LOCK

(75) Inventor: Mu-Lan Huang, Kaohsiung Hsien (TW)

(73) Assignee: Taiwan Fu Hsing Industrial Co., Ltd., Kaohsiung Hsien (TW)

( * ) Notice: Subject to any disclaimer, the term of this patent is extended or adjusted under 35 U.S.C. 154(b) by 0 days.

(21) Appl. No.: 10/136,495

(22) Filed: May 2, 2002

(65) Prior Publication Data

US 2003/0167809 A1 Sep. 11, 2003

(30) Foreign Application Priority Data

Mar. 11, 2002 (TW) ..... 91202818 U

(51) Int. Cl.[7] ..... E05B 17/04

(52) U.S. Cl. ..... 70/379 R; 70/367; 70/371; 70/372

(58) Field of Search ..... 70/379 R, 493, 70/367, 370–373, 375, 380, 381

(56) References Cited

U.S. PATENT DOCUMENTS

| | | | | | |
|---|---|---|---|---|---|
| 1,929,658 | A | * | 10/1933 | Solliday | 70/156 |
| 2,014,233 | A | * | 9/1935 | Keil | 70/367 |
| 2,042,025 | A | * | 5/1936 | Schlage | 70/379 R |
| 2,206,462 | A | * | 7/1940 | Jacobi | 70/490 |
| 2,348,135 | A | * | 5/1944 | Jacobi | 70/379 R |
| 3,605,463 | A | * | 9/1971 | Epstein | 70/493 |
| 4,068,510 | A | * | 1/1978 | Neary | 70/379 R |
| 4,228,669 | A | * | 10/1980 | Bischoff | 70/379 R |
| 4,300,374 | A | * | 11/1981 | Mullich et al. | 70/389 |
| 4,703,638 | A | * | 11/1987 | Bergstrom | 70/369 |
| 4,793,166 | A | * | 12/1988 | Marks | 70/379 R |
| 5,640,864 | A | * | 6/1997 | Miyamoto | 70/379 R |
| 5,907,963 | A | * | 6/1999 | Myers et al. | 70/371 |
| 5,911,766 | A | * | 6/1999 | Lieb et al. | 70/422 |
| 6,089,059 | A | * | 7/2000 | Fan | 70/371 |
| 6,105,405 | A | * | 8/2000 | Westwinkel | 70/371 |
| 6,109,080 | A | * | 8/2000 | Chen et al. | 70/371 |
| 2002/0073754 | A1 | * | 6/2002 | Katagiri et al. | 70/379 R |

* cited by examiner

*Primary Examiner*—Anthony Knight
*Assistant Examiner*—John B. Walsh
(74) *Attorney, Agent, or Firm*—Dennison, Schultz & Dougherty

(57) ABSTRACT

A cylinder assembly for a door lock has a housing, a cylinder, an actuating tongue and a cap. The cylinder is securely held on the housing with a fastener and rotatably received in a through hole in the housing. A recess is defined in one end of the cylinder. A curved channel is defined in a face defining the recess. A connecting portion is formed on the first end of the tongue and is rotatably received in the recess in the cylinder. A protrusion protrudes from the first end of the actuating tongue and extends into the curved channel in the cylinder. The cap is mounted around the actuating tongue and secured to the second end of the cylinder. Accordingly, the cylinder can be easily assembled to or disassembled from the housing by means of attaching or removing the fastener.

14 Claims, 7 Drawing Sheets

CYLINDER ASSEMBLY FOR A DOOR LOCK

BACKGROUND OF THE INVENTION

1. Field of the Invention

The present invention relates to a cylinder assembly, and more particularly to a cylinder assembly for a door lock and that has a simple and easily assembled structure.

2. Description of Related Art

With reference to FIG. 7, a conventional cylinder assembly for a door lock comprises a housing (90), a cylinder (93) and an actuating tongue (94). A through hole (91) is defined through the housing (90) for receiving the cylinder (93). The housing (90) has multiple apertures (92) radially defined in the housing (90) and communicating with the through hole (91). An upper lock pin (921) is moveably received in each respective aperture (92) and extends into the through hole (91). The cylinder (93) is rotatably received in the through hole (91) in the housing (90). A keyhole (not shown) is defined in a first end of the cylinder (93) for a key (97) inserting into the keyhole. An outer thread (932) is formed around a second end of the cylinder (93). Multiple apertures (933) are defined in the cylinder (93) and communicate with the keyhole. Each aperture (933) in the cylinder (93) is aligned with one of the apertures (92) in the housing (90). A lower lock pin (934) is received in each respective aperture (933) in the cylinder (93) and abuts the corresponding upper lock pin (921), and each lower lock pin (934) has a length different from that of the others. A driving pin (936) is moveably mounted in a hole (931) defined in the second end of the cylinder (93), and a spring (935) received in the hole (931) abuts the driving pin (936). A stub (937) with a diameter smaller than that of the driving pin (936) extends from the exposed end of the driving pin (936), such that a shoulder is formed between the driving pin (936) and the stub (937).

The actuating tongue (94) is securely attached to the second end of the cylinder (93) with a cap (96) and is connected to a latch (not shown) of the door lock. The cap (96) has an inner thread (961) to screw with the outer thread (932) on the cylinder (93), such that the cap (96) can securely be attached to the cylinder (93) by means of the engagement between the threads (932,961). A flange (not numbered) is formed on one end of the cap (96), and multiple recesses (962) are defined in the inner periphery of the flange. The stub (937) on the driving pin (936) extends into one of the recesses (962), and the shoulder on the driving pin (936) abuts the inner surface of the flange. A driven plate (95) is mounted around the tongue (94) and has a central hole (951) with a shape corresponding to the cross section of the actuating tongue (95), such that the tongue (94) can rotate with the driven plate (95). The driven plate (95) has two sides respectively abutting the flange on the cap (96) and a plate (941) formed on the tongue (94), such that the tongue (94) can be kept from releasing from the cylinder (93) by the driven plate (95) and the cap (96).

A notch (952) is defined in a periphery of the driven plate (95) and engages with the driving pin (936) on the cylinder (93). When the cylinder (93) is rotated, the driven plate (95) will rotate due to the engagement between the driving pin (936) and the notch (952) so that the tongue (94) will also rotate. The latch of the door lock will be actuated to lock into or unlock from a recess defined in the doorframe.

However, the conventional cylinder assembly has the following drawbacks:

1. To provide threaded portions (932,961) with enough structural strength to the cylinder (93) and the cap (96), the material for forming the cylinder (93) and the cap (96) must has a high structural strength. The cost for manufacturing the conventional cylinder assembly is high.

2. The structure of the conventional cylinder assembly is complicated, such that to assemble or disassemble the cylinder assembly is very troublesome.

To overcome the shortcomings, the present invention tends to provide a cylinder assembly to mitigate or obviate the aforementioned problems.

SUMMARY OF THE INVENTION

The main objective of the invention is to provide a cylinder assembly for a door lock and that can be easily assembled and disassembled. The cylinder assembly has a housing, a cylinder, an actuating tongue and a cap. The cylinder is securely held on the housing with a fastener and rotatably received in a through hole in the housing. A keyhole is defined in a first end of the cylinder, and a recess is defined in a second end of the cylinder. A curved channel is defined in a face defining the recess. The actuating tongue is attached to the second end of the cylinder. A connecting portion is formed on the first end of the tongue and is rotatably received in the recess in the cylinder. A protrusion protrudes from the first end of the actuating tongue and extends into the curved channel in the cylinder. The cap is mounted around the actuating tongue and secured to the second end of the cylinder. In such an arrangement, the cylinder can be easily assembled to or disassembled from the housing by means of attaching or removing the fastener. To assemble or to disassemble the cylinder assemble is easy, and the cost for manufacturing the cylinder assembly is low.

Other objects, advantages and novel features of the invention will become more apparent from the following detailed description when taken in conjunction with the accompanying drawings.

DETAILED DESCRIPTION OF PREFERRED EMBODIMENT

Figure 1:
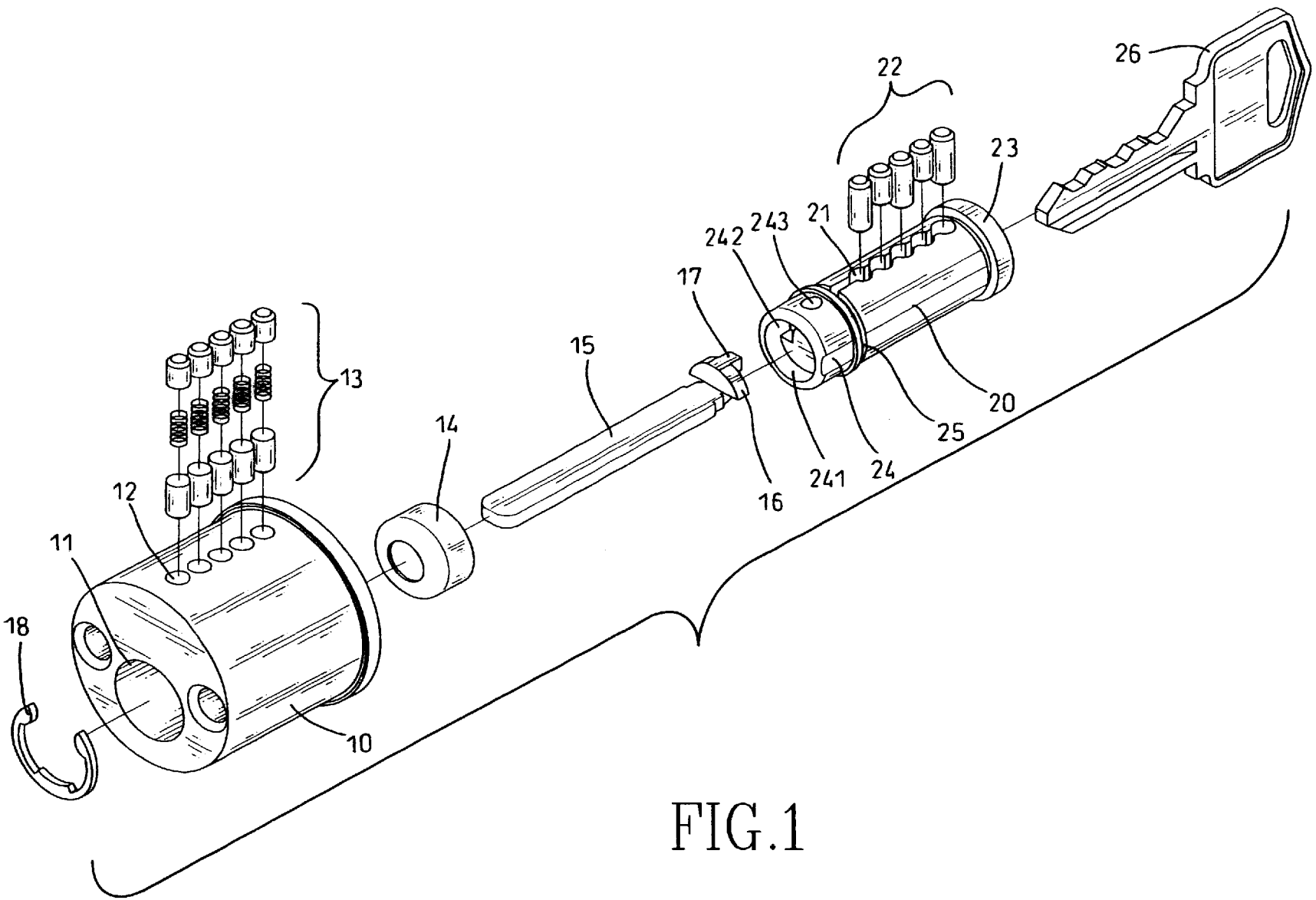
FIG. 1 is an exploded perspective view of a cylinder assembly for a door lock in accordance with the present invention.
Figure 2:
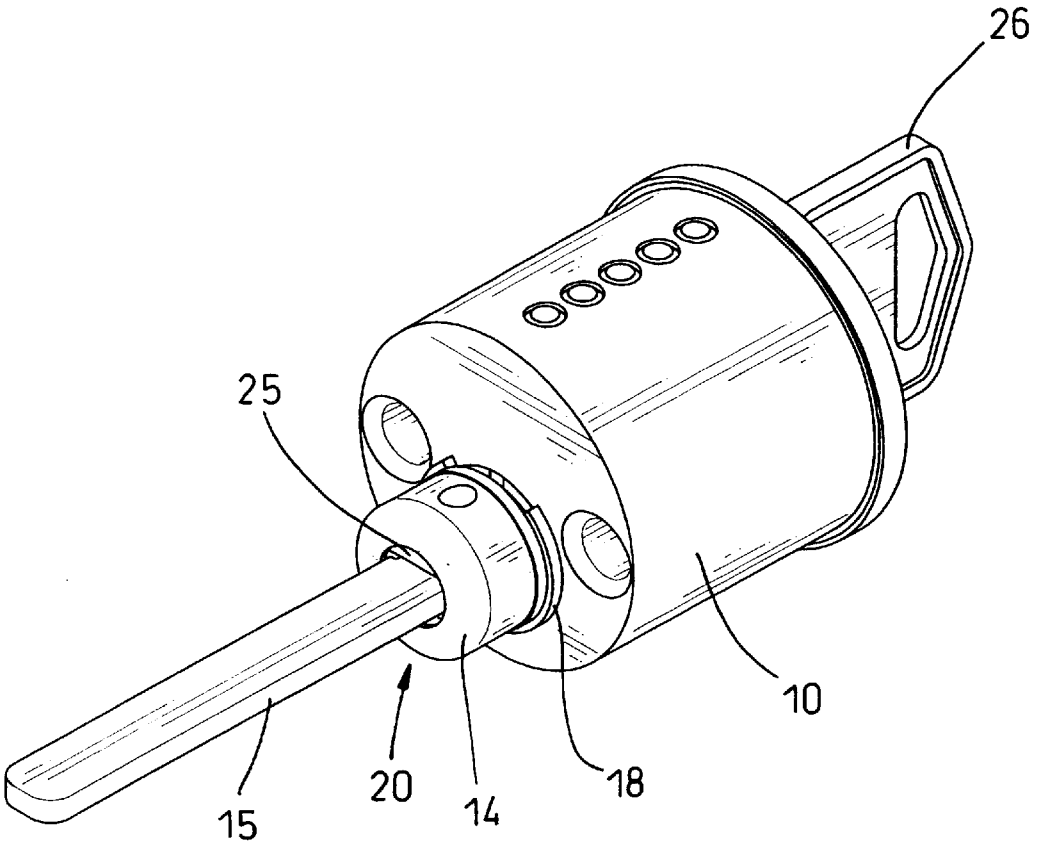
FIG. 2 is a perspective view of the cylinder assembly in FIG. 1.
Figure 3:
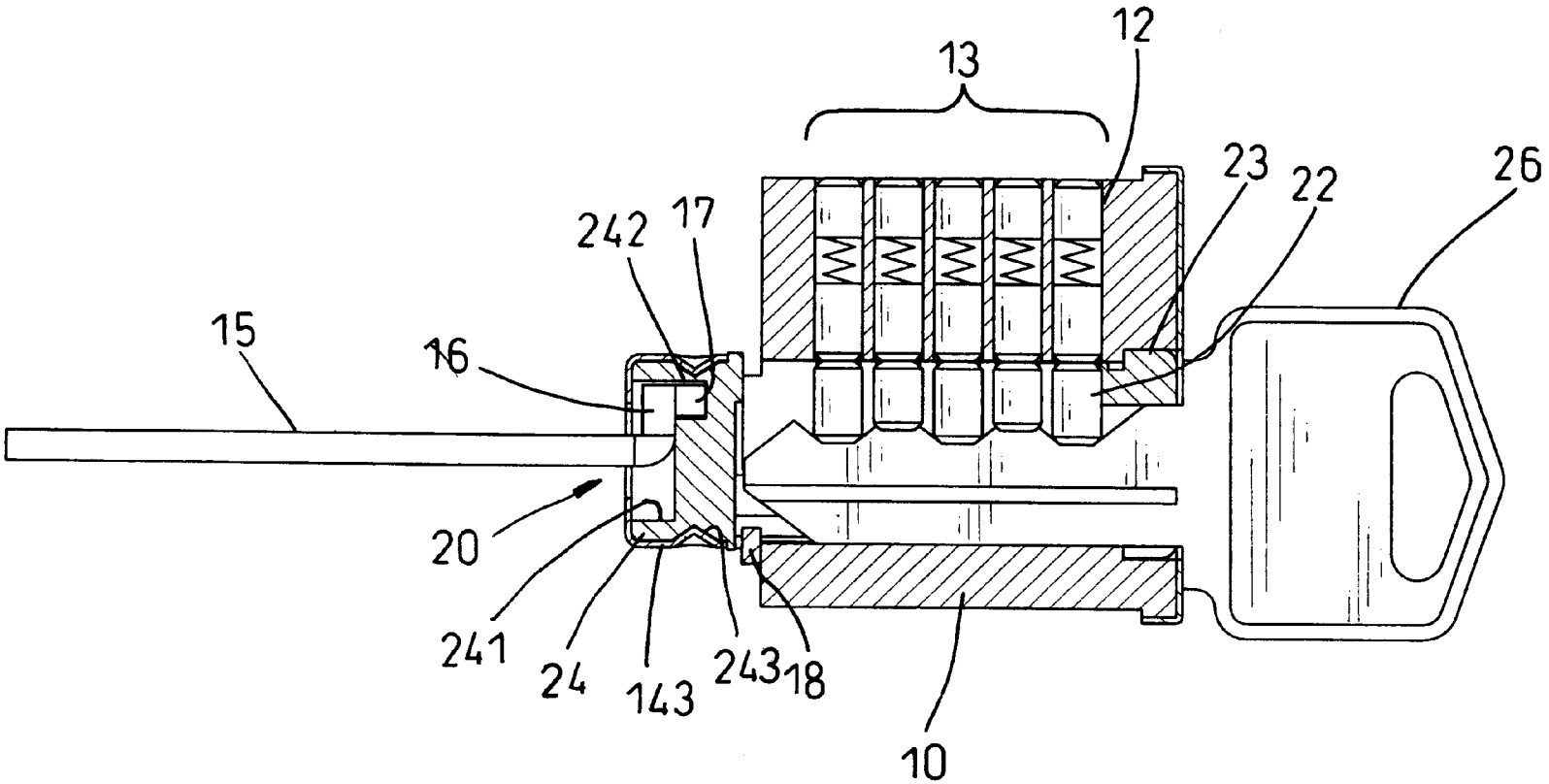
FIG. 3 is a side plan view in partial cross section of the cylinder assembly in FIG. 1.

With reference to FIGS. 1 to 3, a cylinder assembly for a door lock in accordance with the present invention comprises a housing (10), a cylinder (20), an actuating tongue (15) and a cap (14). A through hole (11) is defined through the housing (10) for receiving the cylinder (20). Multiple apertures (12) are defined in the housing (10) and communicate with the through hole (11). An upper lock pin (13) is moveably received in each respective aperture (12) in the housing (10) and extends into the through hole (11). In practice, each upper lock pin (13) comprises an upper pin, a lower pin and a spring mounted between the pins.

The cylinder (20) is rotatably received in the through hole (11) in the housing (10) and has a first end (23) and a second end (24). A keyhole (not numbered) is defined in the first end (23) of the cylinder (20) for a key (26) inserting into the keyhole. The second end (24) of the cylinder (20) is inserted into the through hole (11) from the first end of the housing (10) and extends out from the through hole (11) from the second end of the housing (10). A groove (25) is defined around the exposed second end (24) of the cylinder (20) for a C-shaped or E-shaped fastener (18) being received in the groove (25), such that the cylinder (20) can be securely held on the housing (10) with the fastener (18). A recess (241) is defined in the second end (24) of the cylinder (20). A curved channel (242) is defined in a face defining the recess (241). Multiple apertures (21) are defined in the cylinder (20) and communicate with the keyhole. Each aperture (21) in the cylinder (20) is aligned with one of the apertures (12) in the housing (10). A lower lock pin (22) is received in each respective aperture (21) in the cylinder (20) and abuts the corresponding upper lock pin (13), and each lower lock pin (22) has a length different from those of the others. At least one hole (243) is defined in a periphery of the second end (24) of the cylinder (20).

The actuating tongue (15) has a first end extending into the recess (241) in the cylinder (20) and a second end connected to a latch (not shown) of the door lock. A connecting portion (16) is formed on the first end of the tongue (15) to be rotatably received in the recess (241) in the cylinder (20). In practice, the connecting portion (16) is a block integrally formed on the first end of the tongue (15). A protrusion (17) protrudes from the connecting portion (16) of the tongue (15) and extends into the channel (242) in the cylinder (20). The cap (14) is mounted around the actuating tongue (15) and is secured to the second end (24) of the cylinder (20). A through hole (not numbered) is defined in the cap (14) for the tongue (15) extending through the through hole. A knob (not numbered) is formed on the cap (14) and extends into each respective hole (243) in the second end (24) of the cylinder (20), such that the cap (14) can be securely attached to the second end (24) of the cylinder (20). Accordingly, the connecting portion (16) of the actuating tongue (15) can be securely held in the recess (241) in the cylinder (20).

With such an arrangement, because there is no threaded portion formed on the cap (14) or the cylinder (20), a material with a high structural strength is not needed for forming the cap (14) and the cylinder (20). Therefore, the cost for manufacturing the cylinder assembly is reduced in comparison with prior art. In addition, because the cylinder (20) is securely attached to the housing (10) with a C-shaped or an E-shaped fastener (18), the cylinder (20) is easily assembled with or disassembled from the housing (10) by means of attaching or removing the fastener (18).

Figure 4:
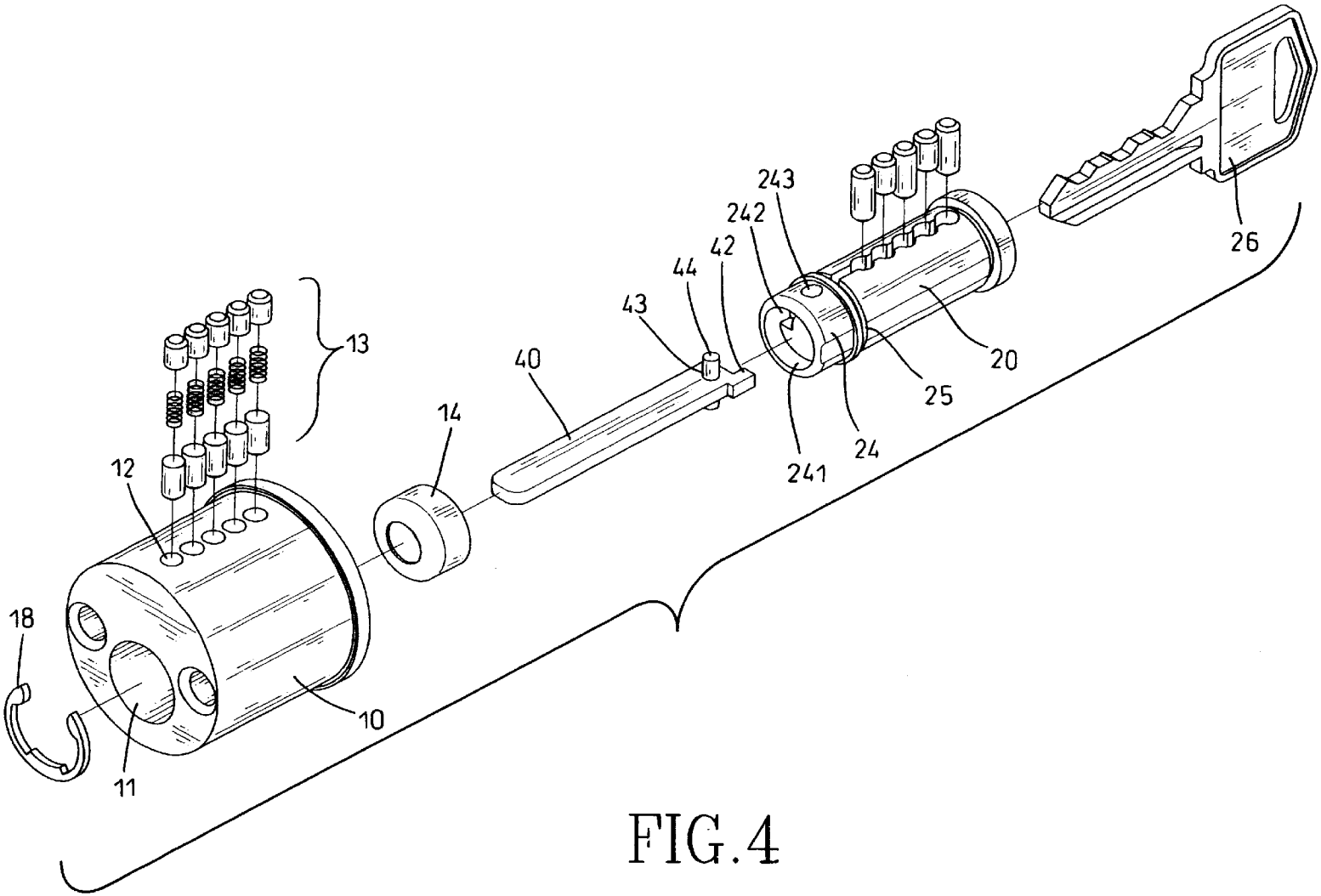
FIG. 4 is an exploded perspective view of a second embodiment of a cylinder assembly in accordance with the present invention.

With reference to FIG. 4, a bore (43) is defined through the first end of the actuating tongue (40), and a pin (44) extends through the bore (43) and is received in the recess (241) in the cylinder (20) to serve as a connecting portion on the actuating tongue (40). A protrusion (42) is formed on the first end of the tongue (40) and extends into the curved channel (242) in the cylinder (20).

Figure 5:
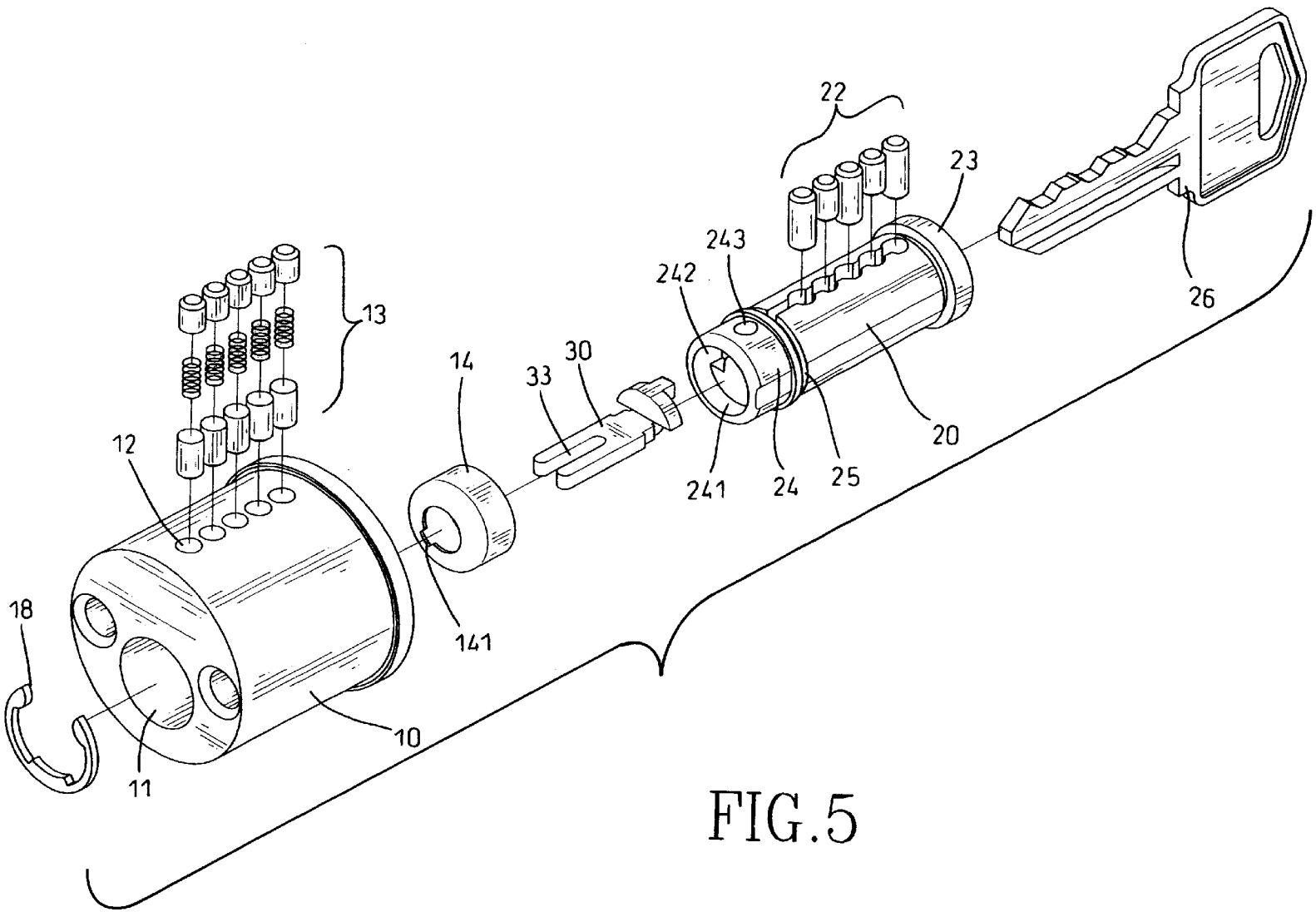
FIG. 5 is an exploded perspective view of a third embodiment of a cylinder assembly in accordance with the present invention.
Figure 6:
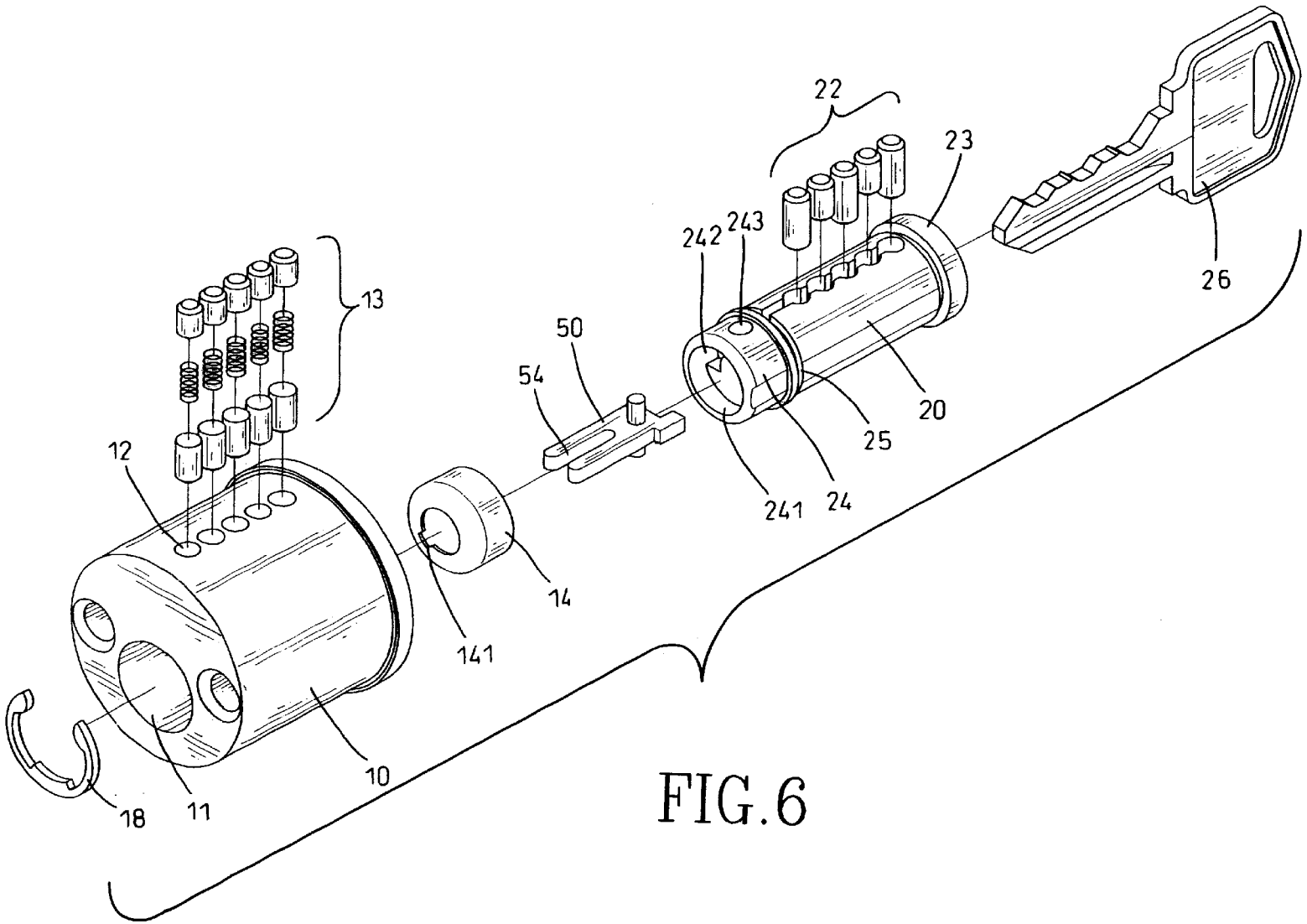
FIG. 6 is an exploded perspective view of a fourth embodiment of a cylinder assembly in accordance with the present invention.
Figure 7:
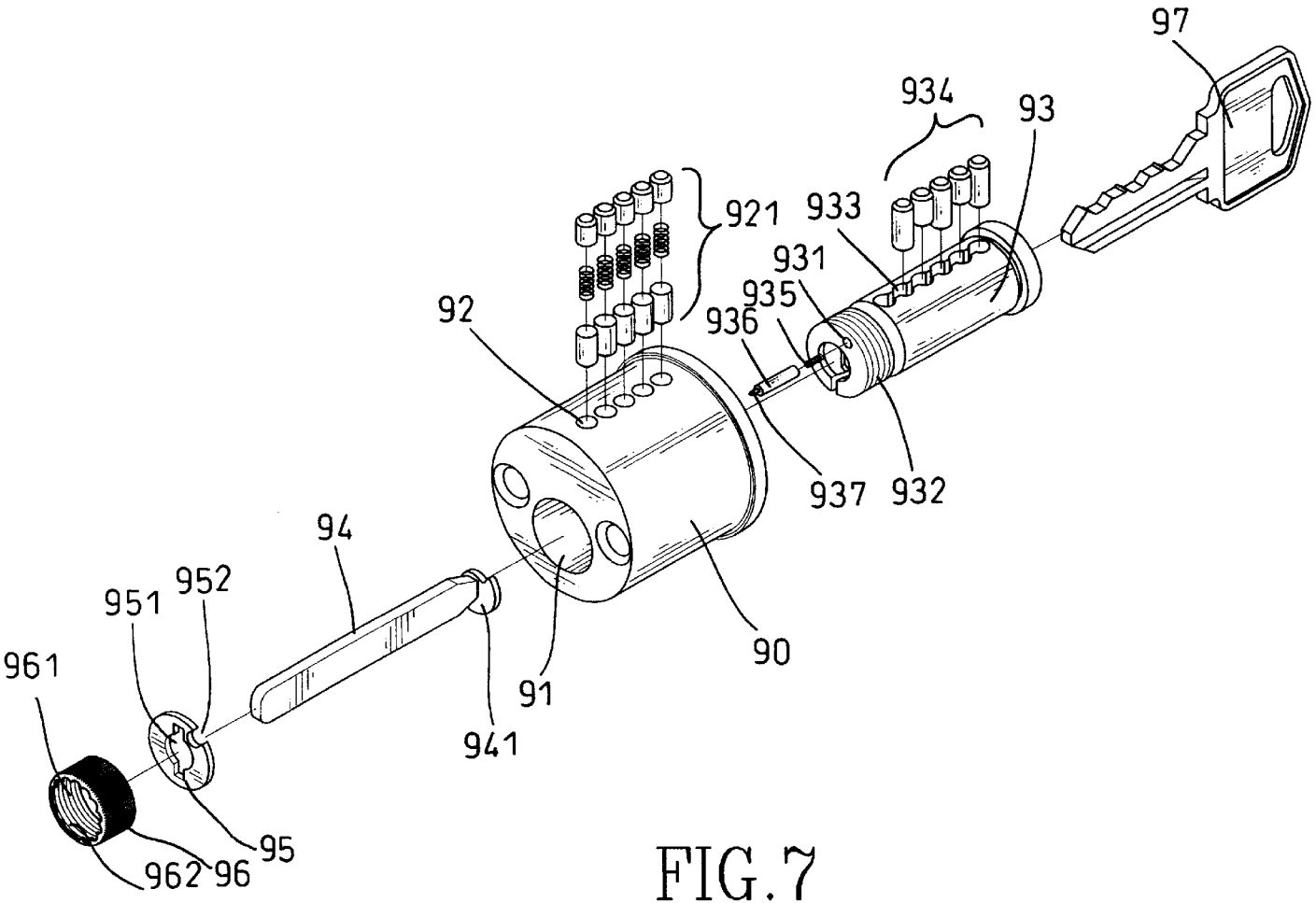
FIG. 7 PRIOR ART
FIG. 7 is an exploded perspective view of a conventional cylinder assembly in accordance with the prior art.

With reference to FIGS. 5 and 6, a slot (33,54) is defined in a second end of the actuating tongue (30,50) and is adapted to engage with the slot (33,54) in the actuating tongue (30,50) of the other cylinder on a same the door lock. A notch (141) is defined in an inner periphery of the through hole in the cap (14) to engage with the actuating tongue (30,50). With the engagement between the tongue (30,50) and the notch (141) in the cap (14), the tongue (30,50) can actually rotate with the cylinder (20). Accordingly, the cylinder assembly can be applied to a door lock with two cylinder assemblies, wherein the cylinder assemblies can actuate each other.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cylinder assembly for a door lock comprising:

a housing having a through hole defined through the housing;

multiple upper lock pins moveably mounted on the housing and extending into the through hole;

a cylinder securely held on the housing with a fastener and rotatably received in the through hole in the housing, the cylinder having a keyhole defined in a first end of the cylinder;

a recess defined in a second end of the cylinder;

a curved channel defined in a face defining the recess; and at least one hole defined in a periphery of the second end of the cylinder;

multiple lower lock pins moveably mounted on the cylinder and extending into the key hole in the cylinder, each respective lower lock pin having a length different from lengths of the other lower lock pins and abutting one of the upper lock pins on the housing;

an actuating tongue attached to the second end of the cylinder and having a first end extending into the recess in the cylinder and a second end adapted to be connected to a latch of the door lock, the actuating tongue further having a connecting portion formed on the first end of the tongue to be rotatably received in the recess in the cylinder and a protrusion protruding from the first end of the actuating tongue and extending into the curved channel in the cylinder; and a cap mounted around the actuating tongue and secured to the second end of the cylinder, the cap having a through hole for the actuating tongue extending through the through hole in the cap and a knob formed on the cap and extending into each respective at least one hole in the second end of the cylinder so as to securely attach the cap to the second end of the cylinder;

wherein the cylinder has a groove defined around the second end of the cylinder for the fastener being received in the groove so as to securely hold the cylinder on the housing with the fastener.

2. The cylinder assembly as claimed in claim 1, wherein the housing has multiple apertures defined in the housing and communicating with the through hole in the housing; and each upper lock pin is moveably received in a respective one of the apertures in the housing.

3. The cylinder assembly as claimed in claim 2, wherein the cylinder has multiple apertures defined in the cylinder and communicating with the keyhole; and each aperture in the cylinder is aligned with a respective one of the apertures in the housing to receive one of the lower lock pins.

4. The cylinder assembly as claimed in claim 3, wherein each upper lock pin is composed of an upper pin, a lower pin and a spring mounted between the pins.

5. The cylinder assembly as claimed in claim 1, wherein a slot is defined in the second end of the actuating tongue and is adapted to engage with a slot in an actuating tongue of another cylinder in the door lock.

6. The cylinder assembly as claimed in claim 5, wherein a notch is defined in an inner periphery of the through hole in the cap to engage with the actuating tongue.

7. The cylinder assembly as claimed in claim 1, wherein the fastener is an E-shaped fastener.

8. The cylinder assembly as claimed in claim 1, wherein the connecting portion on the actuating tongue is a block integrally formed on the first end of the actuating tongue; and the protrusion is formed on the connecting portion.

9. The cylinder assembly as claimed in claim 8, wherein a slot is defined in the second end of the actuating tongue and is adapted to engage with the slot in the actuating tongue of the other cylinder in the door lock.

10. The cylinder assembly as claimed in claim 9, wherein a notch is defined in an inner periphery of the through hole in the cap to engage with the actuating tongue.

11. The cylinder assembly as claimed in claim 1, wherein the connecting portion on the actuating tongue is a pin extending through a bore defined in the actuating tongue.

12. The cylinder assembly as claimed in claim 11, wherein a slot is defined in the second end of the actuating tongue and is adapted to engage with a slot in an actuating tongue of another cylinder in the door lock.

13. The cylinder assembly as claimed in claim 12, wherein a notch is defined in an inner periphery of the through hole in the cap to engage with the actuating tongue.

14. The cylinder assembly as claimed in claim 1, wherein the fastener is a C-shaped fastener.

* * * * *